US009886908B2

(12) United States Patent
Tani et al.

(10) Patent No.: US 9,886,908 B2
(45) Date of Patent: Feb. 6, 2018

(54) TIMING CONTROLLER OF OPERATING SELECTIVE SENSING AND ORGANIC LIGHT EMITTING DISPLAY DEVICE COMPRISING THE SAME

(71) Applicant: LG Display Co., Ltd., Seoul (KR)

(72) Inventors: Ryosuke Tani, Gyeonggi-do (KR); SungJoon Bae, Gyeonggi-do (KR); NaYoung Bae, Busan (KR)

(73) Assignee: LG Display Co., Ltd., Seoul (KR)

( * ) Notice: Subject to any disclaimer, the term of this patent is extended or adjusted under 35 U.S.C. 154(b) by 38 days.

(21) Appl. No.: 15/195,402

(22) Filed: Jun. 28, 2016

(65) Prior Publication Data

US 2017/0004765 A1 Jan. 5, 2017

(30) Foreign Application Priority Data

Jun. 30, 2015 (KR) ..... 10-2015-0093636

(51) Int. Cl.
*G09G 3/3275* (2016.01)
*G09G 3/3233* (2016.01)

(52) U.S. Cl.
CPC ..... *G09G 3/3275* (2013.01); *G09G 3/3233* (2013.01); *G09G 2320/029* (2013.01); *G09G 2320/041* (2013.01); *G09G 2320/045* (2013.01); *G09G 2320/048* (2013.01)

(58) Field of Classification Search
None
See application file for complete search history.

(56) References Cited

U.S. PATENT DOCUMENTS 9,495,909 B2 * 11/2016 Tani ..... G09G 3/3233
2008/0238901 A1 * 10/2008 Taneda ..... G09G 3/3233 345/204
2009/0315918 A1 * 12/2009 Minami ..... G09G 3/3233 345/690
2010/0117932 A1 * 5/2010 Yamashita ..... G09G 3/3233 345/55
2010/0149167 A1 * 6/2010 Hasegawa ..... G09G 3/3225 345/213
2015/0339974 A1 * 11/2015 Wu ..... G09G 3/3233 345/690
2016/0351095 A1 * 12/2016 Tani ..... G09G 3/3275

FOREIGN PATENT DOCUMENTS

KR 102017080935 * 7/2017

* cited by examiner

*Primary Examiner* — Joseph Haley
*Assistant Examiner* — Karin Kiyabu
(74) *Attorney, Agent, or Firm* — Morgan, Lewis & Bockius LLP

(57) ABSTRACT

There are provided a timing controller of operating selective sensing and an organic light emitting display device comprising the same, the timing controller being configured to selectively perform a sensing when a display panel operates in an ON state. The timing controller performs a sensing to the display panel on the basis of a temperature of the display panel, a time difference in operation of the display panel, and a degree of need for sensing of representative sub-pixels.

12 Claims, 13 Drawing Sheets

Vth SENSING

Vsense WAVE

Mobility SENSING

Vsense WAVE

TIMING CONTROLLER OF OPERATING SELECTIVE SENSING AND ORGANIC LIGHT EMITTING DISPLAY DEVICE COMPRISING THE SAME

CROSS-REFERENCE TO RELATED APPLICATIONS

This application claims priority from Korean Patent Application No. 10-2015-0093636, filed on Jun. 30, 2015, which is hereby incorporated by reference for all purposes as if fully set forth herein.

BACKGROUND OF THE INVENTION

Field of the Invention

The present invention relates to a timing controller that operates a selective sensing and an organic light emitting display device including the same.

Description of the Related Art

With progress of the information-oriented society, various types of demands for display devices for displaying an image are increasing. Recently, various types of display devices such as a liquid crystal display (LCD) device, a plasma display panel (PDP) device, or an organic light emitting display (OLED) device have been used. Such various types of display devices respectively include display panels suitable therefor.

An organic light emitting display device which has recently attracted attention as a display device uses a self-emitting organic light emitting diode (OLED) and thus has the advantages of a high response speed and increased contrast ratio, light emitting efficiency, brightness and viewing angle.

Each sub-pixel disposed in an organic light emitting display panel of the organic light emitting display device basically includes a driving transistor configured to drive the organic light emitting diode (OLED), a switching transistor configured to transfer a data voltage to a gate node of the driving transistor, and a capacitor configured to maintain a certain voltage for one frame time.

Meanwhile, the driving transistor within each sub-pixel has characteristics such as a threshold voltage, and mobility. Such characteristics may vary by the driving transistor.

Further, as a driving time is increased, the driving transistor may be degraded and changed in characteristics. A difference in the degree of degradation may cause variations in characteristics between the driving transistors.

The variations in characteristics between the driving transistors may cause a brightness variation and thus cause brightness unevenness of the organic light emitting display device.

Accordingly, a technology for sensing characteristics of a driving transistor and compensating a difference between the characteristics has been developed. However, as a size of a display device is increased, the number of driving transistors is increased and a size of each driving transistor is decreased. Thus, a sensing time of identifying characteristics of a transistor in a short time has been increased. Further, if a display device is turned on, a sensing is performed before driving the display device in order to realize uniform brightness. In this case, an initial driving time is needed.

SUMMARY

Accordingly, the present invention is directed to a timing controller of operating selective sensing and an organic light emitting display device having the same that substantially obviates one or more of the problems due to limitations and disadvantages of the related art.

An object of the present invention is to provide a display that is more convenient to a user by reducing a time of sensing characteristics of a panel while maintaining the display performance of the panel when the panel is turned on.

Another object of the present invention is to provide a display that also reduces a time required for displaying an image when a display panel is in an ON state by determining whether or not to turn on the display panel without a sensing or whether or not to perform a selective sensing to some of sub-pixels in the display panel.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, an organic light emitting display device comprises a display panel in which a plurality of sub-pixels is disposed; a gate driver configured to apply a signal to a gate line in the display panel; a data driver configured to apply a signal to a data line in the display panel; and a timing controller configured to control the gate driver and the data driver by calculating any one or more of a temperature of the display panel, an OFF-ON time difference of the display panel, and a degree of need for sensing of the sub-pixels and determining whether or not to perform a sensing to the display panel when the display panel is changed from an OFF state to an ON state.

In another aspect, a timing controller that controls a gate driver configured to apply a signal to a gate line in a display panel in which a plurality of sub-pixels is disposed and a data driver configured to apply a signal to a data line in the display panel, and controls the gate driver and the data driver by calculating any one or more of a temperature of the display panel, an OFF-ON time difference of the display panel, and a degree of need for sensing of the sub-pixels and determining whether or not to perform a sensing to the display panel when the display panel is changed from an OFF state to an ON state.

According to exemplary embodiments of the present invention, it is possible to provide a display which is more convenient to a user by reducing a time of sensing characteristics of a panel when the panel is turned on while maintaining the display performance of the panel.

According to exemplary embodiments of the present invention, it is possible to reduce a time required for displaying an image when a display panel is in an ON state by determining whether or not to turn on the display panel without a sensing or whether or not to perform a selective sensing to some of sub-pixels in the display panel.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention. In the drawings.

DETAILED DESCRIPTION OF THE EMBODIMENT

Figure 1:
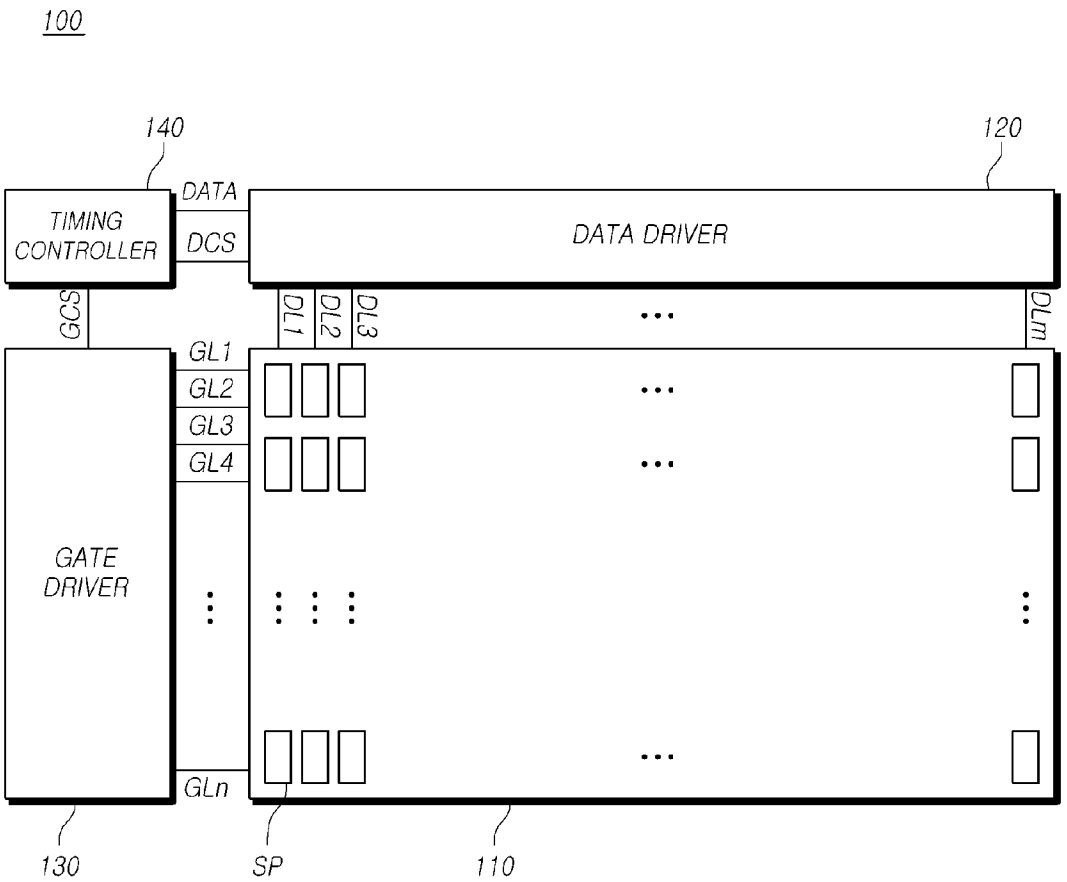
FIG. 1 is a system configuration view of an organic light emitting display device according to the present exemplary embodiments.

Hereinafter, some embodiments of the present invention will be described in detail with reference to the accompanying drawings. When reference numerals refer to components of each drawing, although the same components are illustrated in different drawings, the same components are referred to by the same reference numerals as possible. Further, if it is considered that description of related known configuration or function may cloud the gist of the present invention, the description thereof will be omitted.

Further, in describing components of the present invention, terms such as first, second, A, B, (a), and (b) can be used. These terms are used only to differentiate the components from other components. Therefore, the nature, order, sequence, or number of the corresponding components is not limited by these terms. It is to be understood that when one element is referred to as being "connected to" or "coupled to" another element, it may be directly connected to or directly coupled to another element, connected to or coupled to another element, having still another element "intervening" therebetween, or "connected to" or "coupled to" another element via still another element.

FIG. 1 is a schematic system configuration view of an organic light emitting display device 100 according to the present exemplary embodiments.

Referring to FIG. 1, the organic light emitting display device 100 according to the present exemplary embodiments includes a display panel 110 in which a plurality of data lines DL to DLm and a plurality of gate lines GL1 to GLn are disposed and a plurality of sub-pixels is disposed, a data driver 120 connected to an upper end or a lower end of the display panel 110 and configured to drive the plurality of data lines DL to DLm, a gate driver 130 configured to drive the plurality of gate lines GL1 to GLn, and a timing controller 140 configured to control the data driver 120 and the gate driver 130.

Referring to FIG. 1, a plurality of sub-pixels SP is disposed in a matrix type in the display panel 110.

Therefore, a plurality of sub-pixel lines is present in the display panel 110. The sub-pixel lines may be sub-pixel rows or sub-pixel columns. In the following, a sub-pixel row will be described as a sub-pixel line.

The data driver 120 drives the plurality of data lines DL1 to DLm by supplying a data voltage to the plurality of data lines DL1 to DLm. Herein, the data driver 120 may also be referred to as a source driver. The gate driver 130 sequentially drives the plurality of gate lines GL1 to GLn by sequentially supplying a scan signal to the plurality of gate lines GL1 to GLn. Herein, the gate driver 130 may also be referred to as a scan driver.

Furthermore, the timing controller 140 controls the data driver 120 and the gate driver 130 by supplying various control signals to the data driver 120 and the gate driver 130.

The timing controller 140 starts a scan according to timing implemented in each frame, converts image data input from the outside to be suitable for a data signal form used by the data driver 120, outputs the converted image data, and controls a driving of data at a proper time corresponding to the scan.

The gate driver 130 sequentially drives the plurality of gate lines GL1 to GLn by sequentially supplying an ON voltage or OFF voltage scan signal to the plurality of gate lines GL1 to GLn according to the control of the timing controller 140.

The gate driver 130 may be located at only one side of the display panel 110 as illustrated in FIG. 1 or may be located at both sides thereof if necessary according to the driving method or the design of the display panel. Further, the gate driver 130 may include one or more gate driver integrated circuits GDIC.

If a specific gate line is opened, the data driver 120 converts image data received from the timing controller 140 into a data voltage of an analog form and supplies the data voltage to the plurality of data lines DL1 to DLm to drive the plurality of data lines DL1 to DLm.

The data driver 120 may include at least one source driver integrated circuit SDIC to drive the plurality of data lines.

Each of the above-described gate driver integrated circuits or source driver integrated circuits may be connected to a bonding pad of the display panel 110 through a Tape Automated Bonding (TAB) method or a Chip On Glass (COG) method, or directly disposed in the display panel 110, or may be integrated and disposed in the display panel 110 if necessary.

Each source driver integrated circuit may include a logic unit including a shift register, a latch circuit, and the like, a digital-analog converter DAC, an output buffer, and the like, and may further include a sensing unit (310 in FIG. 3) for sensing characteristics (for example, a threshold voltage and a mobility of a driving transistor, a threshold voltage of an organic light emitting diode, a brightness of a sub-pixel, and the like.) of a sub-pixel in order to compensate the characteristics of the sub-pixel if necessary.

Otherwise, each source driver integrated circuit may be implemented in a Chip On Film (COF) type. In this case, one end of the source driver integrated circuit is bonded to at least one source printed circuit board and the other end is bonded to the display panel 110.

Meanwhile, the timing controller 140 receives input image data together with various timing signals, such as a vertical synchronization signal Vsync, a horizontal synchronization signal Hsync, an input data enable (DE) signal, a clock signal CLK, and the like, from the outside (for example, a host system).

The timing controller 140 converts the input image data input from the outside in correspondence to a data signal form used by the data driver 120 and outputs the converted image data Data. Further, in order to control the data driver 120 and the gate driver 130, the timing controller 140 receives timing signals, such as a vertical synchronization signal Vsync, a horizontal synchronization signal Hsync, an input DE signal, and a clock signal, generates various control signals, and outputs the control signals to the data driver 120 and the gate driver 130.

For example, the timing controller 140 outputs various gate control signals (GCS) including a gate start pulse (GSP), a gate shift clock (GSC), a gate output enable (GOE) signal, and the like in order to control the gate driver 130.

Herein, the gate start pulse (GSP) controls an operation start timing of the one or more gate driver integrated circuits constituting the gate driver 130. The gate shift clock (GSC) is a clock signal commonly input to the one or more gate driver integrated circuits, and controls a shift timing of a scan signal (gate pulse). The gate output enable (GOE) signal designates timing information of the one or more gate driver integrated circuits.

Further, the timing controller 140 outputs various data control signals (DCS) including a source start pulse (SSP), a source sampling clock (SSC), a source output enable (SOE) signal, and the like in order to control the data driver 120.

Herein, the source start pulse (SSP) controls a data sampling start timing of the one or more source driver integrated circuits constituting the data driver 120. The source sampling clock (SSC) is a clock signal for controlling a data sampling timing in each source driver integrated circuit. The source output enable (SOE) signal controls an output timing of the data driver 120.

Referring to FIG. 1, the timing controller 140 may be disposed in a control printed circuit board connected through a connection medium, such as a flexible flat cable (FFC) or a flexible printed circuit (FPC), to the source printed circuit board to which at least one source driver integrated circuit is bonded.

In the organic light emitting display device 100 according to the present exemplary embodiments, each sub-pixel SP includes an organic light emitting diode OLED and circuit elements such as a transistor to driving the organic light emitting diode OLED. The kind and number of circuit elements constituting each sub-pixel SP may be determined in various ways depending on a function to be provided and a design.

Meanwhile, in the organic light emitting display device 100, as a driving time of each sub-pixel SP is increased, an organic light emitting diode OLED and circuit elements such as a driving transistor DRT are degraded. Therefore, intrinsic characteristics (for example, a threshold voltage, a mobility, and the like) of the organic light emitting diode OLED and the circuit elements such as a driving transistor DRT are changed.

The degree of change in characteristics may be different between circuit elements due to a difference in the degree of degradation between the circuit elements.

A difference in characteristics between the circuit elements may cause a difference in brightness between sub-pixels SP. Accordingly, the brightness uniformity of the display panel 110 may deteriorate, and, thus, an image quality may be lowered.

The organic light emitting display device 100 according to the present exemplary embodiments may provide a "sub-pixel compensation function" of compensating a difference in characteristics between circuit elements of the respective sub-pixels SP.

In the organic light emitting display device 100 according to the present exemplary embodiments, each sub-pixel SP has a structure capable of sensing sub-pixel characteristics and compensating a difference in sub-pixel characteristics.

Further, the organic light emitting display device 100 according to the present exemplary embodiments may include a sensing configuration for sensing sub-pixel characteristics and a compensation configuration for compensating a difference in characteristics between sub-pixels using a sensing result from the sensing configuration, in order to provide the sub-pixel compensation function.

Herein, the sub-pixel characteristics may include, for example, characteristics, such as a threshold voltage, of the organic light emitting diode OLED and characteristics, such as a threshold voltage and a mobility, of the driving transistor DRT. In the following, a threshold voltage and a mobility of the driving transistor DRT will be exemplified as the sub-pixel characteristics.

Figure 2:
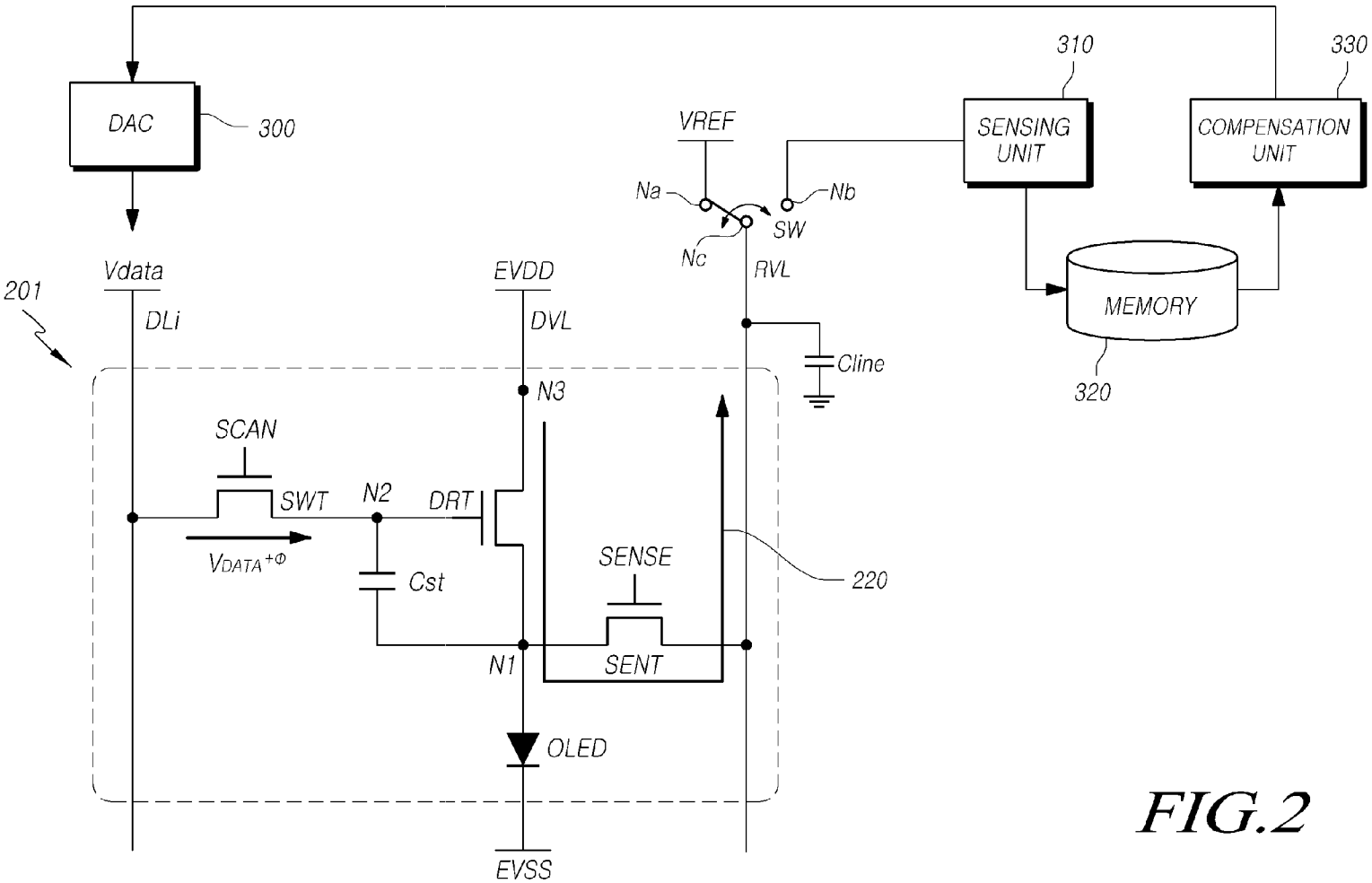
FIG. 2 is a diagram illustrating a sub-pixel circuit and a sub-pixel compensation circuit of an organic light emitting display device according to the present exemplary embodiments.

FIG. 2 is a diagram illustrating a sub-pixel circuit and a sub-pixel compensation circuit of the organic light emitting display device 100 according to the present exemplary embodiments.

A sub-pixel circuit 201 illustrated in FIG. 2 will be described first. A sub-pixel is a random sub-pixel configured to be supplied with a data voltage Vdata from an ith data line DLi ($1 \leq I \leq m$), and has a structure capable of sensing sub-pixel characteristics and compensating a difference in sub-pixel characteristics.

Referring to FIG. 2, in the organic light emitting display device 100 according to the present exemplary embodiments, each sub-pixel includes an organic light emitting diode OLED and a driving circuit configured to drive the organic light emitting diode OLED.

The driving circuit may include a driving transistor DRT, a switching transistor SWT, a sensing transistor SENT, and a storage capacitor Cst.

The driving transistor DRT supplies a driving current to the organic light emitting diode OLED to drive the organic light emitting diode OLED. The driving transistor DRT may be connected between the organic light emitting diode OLED and a driving voltage line DVL that supplies a driving voltage EVDD. The driving transistor DRT includes a first node N1 corresponding to a source node or a drain node, a second node N2 corresponding to a gate node, and a third node N3 corresponding to the drain node or the source node.

The switching transistor SWT is connected between the data line DLi and the second node N2 of the driving transistor DRT and turned on upon receipt of a scan signal SCAN through the gate node. The switching transistor SWT is turned on by the scan signal SCAN and transfers a data voltage Vdata supplied from the data line DLi to the second node N2 of the driving transistor DRT.

The sensing transistor SENT is connected between the first node N1 of the driving transistor DRT and a reference voltage line RVL that supplies a reference voltage VREF and turned on upon receipt of a sensing signal SENSE, which is one kind of scan signals, through the gate node. The sensing transistor SENT is turned on by the sensing signal SENSE and applies the reference voltage VREF supplied through the reference voltage line RVL to the first node N1 of the driving transistor DRT. Further, the sensing transistor SENT may also function as a sensing path that enables the sensing configuration to sense a voltage of the first node N1 of the driving transistor DRT.

Meanwhile, the scan signal SCAN and the sensing signal SENSE may be respectively applied to the gate node of the switching transistor SWT and the gate node of the sensing transistor SENT through different gate lines.

In some cases, the scan signal SCAN and the sensing signal SENSE may be the same signal and respectively applied to the gate node of the switching transistor SWT and the gate node of the sensing transistor SENT through the same gate line.

Meanwhile, components for compensation of a sub-pixel 210 will be described. The organic light emitting display device 100 according to the present exemplary embodiments may include a sensing unit 310 configured to sense sub-pixel characteristics, a memory 320 configured to store a sensing result from the sensing unit 310, and a compensation unit 330 configured to compensate a difference in sub-pixel characteristics. For example, the sensing unit 310 may be included in a source driver integrated circuit and the compensation unit 330 may be included in a timing controller 140.

The organic light emitting display device 100 according to the present exemplary embodiments may further include a switch SW in order to control a sensing operation, i.e., in order to control a voltage-applied state of the first node N1 of the driving transistor DRT within the sub-pixel SP to be in a state required for sensing of sub-pixel characteristics. One end Nc of the reference voltage line RVL may be connected to a reference voltage supply node Na or a node Nb of the sensing unit 310 through the switch SW.

The reference voltage line RVL is basically configured to supply the reference voltage VREF to the first node N1 of the driving transistor DRT through the sensing transistor SENT. Meanwhile, a line capacitor Cline is formed on the reference voltage line RVL. The sensing unit 310 is configured to sense a voltage charged in the line capacitor Cline on the reference voltage line RVL at a necessary point of time. Therefore, in the following, the reference voltage line RVL may also be described as a sensing line.

For example, one reference voltage line RVL may be disposed on every sub-pixel column or may be disposed on every two or more sub-pixel columns.

For example, if one pixel includes four sub-pixels (a red sub-pixel, a white sub-pixel, a green sub-pixel, and a blue sub-pixel), one reference voltage line RVL may be disposed on every pixel column.

The sensing unit 310 may perform a sensing process by sensing a voltage of the sensing line RVL electrically connected to the first node N1 of the driving transistor DRT within a sub-pixel on a sensing sub-pixel line SSPL for sensing operation among a plurality of sub-pixel lines and outputting a sensing value.

The sensing unit 310 may sense a voltage charged in the line capacitor Cline on the sensing line RVL by a current flowing to the sensing line RVL.

Herein, the voltage charged in the line capacitor Cline is a voltage of the sensing line RVL and represents a voltage of the first node N1 of the driving transistor DRT which reflects characteristics (threshold voltage, mobility) of the driving transistor DRT.

During a sensing operation, a voltage of the first node N1 of the driving transistor DRT is stored in the line capacitor Cline and the sensing unit 310 does not directly sense the voltage of the first node N1 of the driving transistor DRT but senses a voltage charged in the line capacitor Cline which stores the voltage of the first node N1 of the driving transistor DRT. Thus, even when the sensing transistor SENT is turned off, it is possible to sense the voltage of the first node N1 of the driving transistor DRT.

Each sub-pixel may be driven to sense a threshold voltage of the driving transistor DRT or to sense a mobility of the driving transistor DRT.

Therefore, a sensing value sensed by the sensing unit 310 may be a sensing value for sensing a threshold Vth of the driving transistor DRT or a sensing value for sensing a mobility of the driving transistor DRT.

If the sub-pixel is driven to sense a threshold voltage of the driving transistor DRT, when a threshold voltage sensing operation is performed, the first node N1 and the second node N2 of the driving transistor DRT are initialized to a data voltage Vdata for threshold voltage sensing operation and the reference voltage VREF, respectively. Then, the first node N1 of the driving transistor DRT is floated and thus a voltage of the first node N1 of the driving transistor DRT is increased. After the elapse of a predetermined period of time, the voltage of the first node N1 of the driving transistor DRT is saturated.

Herein, the saturated voltage Vdata-Vth of the first node N1 of the driving transistor DRT is charged in the line capacitor Cline on the sensing line RVL.

When it is time for sensing (sampling), the sensing unit 310 senses a voltage charged in the line capacitor Cline. Herein, the sensed voltage Vsense corresponds to a voltage obtained by subtracting the threshold voltage Vth of the driving transistor DRT from the data voltage Vdata.

If the sub-pixel is driven to sense a mobility of the driving transistor DRT, when a mobility sensing operation is performed, the first node N1 and the second node N2 of the driving transistor DRT are initialized to the data voltage Vdata for mobility sensing operation and the reference voltage VREF, respectively. Then, both the first node N1 and the second node N2 of the driving transistor DRT are floated and thus voltages of the first node N1 and the second node N2 are increased.

Herein, a voltage increasing speed (variation of voltage increase over time) represents a current performance, i.e., mobility, of the driving transistor DRT. Therefore, in the driving transistor DRT having a higher current performance (mobility), a voltage of the first node N1 of the driving transistor DRT is increased more steeply.

According to the voltage increase, the line capacitor Cline on the sensing line RVL is charged by a current flowing to the sensing line RVL through the driving transistor DRT.

The sensing unit 310 senses a voltage Vsense charged in the line capacitor Cline on the sensing line RVL.

The memory 320 may store a sensing value for each of a predetermined number N of sensing sub-pixel lines SSPL.

The predetermined number N of sensing sub-pixel lines SSPL may be equal to or lower than the number of all sub-pixel lines present in the display panel 110 depending on an available capacity of the memory 320.

In the following, the predetermined number N of sensing sub-pixel lines SSPL will be described only as being lower than the number of all sub-pixel lines. For example, the number N of sensing sub-pixel lines will be described as 35.

For example, if the organic light emitting display device 100 has a RWGB pixel structure and has a resolution of 1920×1080 (i.e., m=4×1920, n=1080), only 35 sub-pixel lines of 1080 sub-pixel lines are sensed as sensing sub-pixel lines.

The compensation unit 330 may perform a characteristic compensation process by figuring out characteristics (for example, threshold voltage, mobility) of the driving transistor DRT within the corresponding sub-pixel on the basis of the sensing value stored in the memory 320.

Herein, the characteristic compensation process may include a threshold voltage compensation process for compensating a threshold voltage of the driving transistor DRT and a mobility compensation process for compensating a mobility of the driving transistor DRT, or may include any one of them. A function of the characteristic compensation process may be provided by any one of the data driver and the timing controller.

The threshold voltage compensation process may include: calculating a compensation value (threshold voltage compensation value) for compensating a threshold voltage; and storing the calculated compensation value in the memory 320 or modifying the corresponding image data Data with the calculated compensation value.

The mobility compensation process may include: calculating a compensation value for compensating a mobility; and storing the calculated compensation value in the memory 320 or modifying the corresponding image data Data with the calculated compensation value.

The compensation unit 330 may modify the image data Data through the threshold voltage compensation process or the mobility compensation process and then supply the modified data to a source driver integrated circuit.

In this case, a digital-analog converter (DAC) 300 within the source driver integrated circuit converts the data into a data voltage Vdata corresponding to an analog voltage and supplies the data voltage Vdata to the corresponding sub-pixel, so that a characteristic compensation (threshold voltage compensation, mobility compensation) is actually applied.

The characteristics of the driving transistor can be compensated by the compensation unit 330, and, thus, a brightness difference between sub-pixels can be reduced or suppressed.

In the following, a principle of sensing a threshold voltage Vth of a driving transistor DRT to compensate a threshold voltage difference between driving transistors DRT will be briefly explained with reference to FIG. 3. Then, a principle of sensing a mobility of a driving transistor DRT to compensate a mobility difference between driving transistors DRT will be briefly explained with reference to FIG. 4.

The sensing unit 310 may be implemented as including an analog-digital converter ADC configured to convert an analog voltage value into a digital value.

Figure 3:
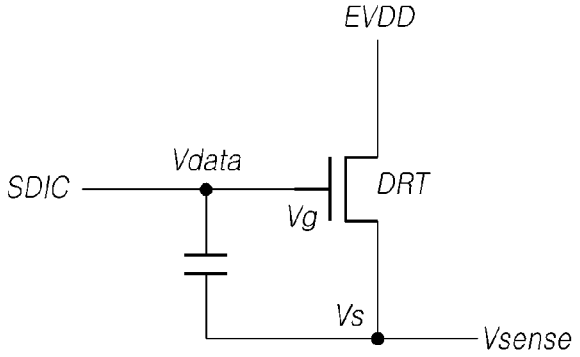
FIG. 3 is a diagram provided to explain a principle of sensing a threshold voltage of a driving transistor DRT of an organic light emitting display device 100 according to the present exemplary embodiments.
Figure 3:
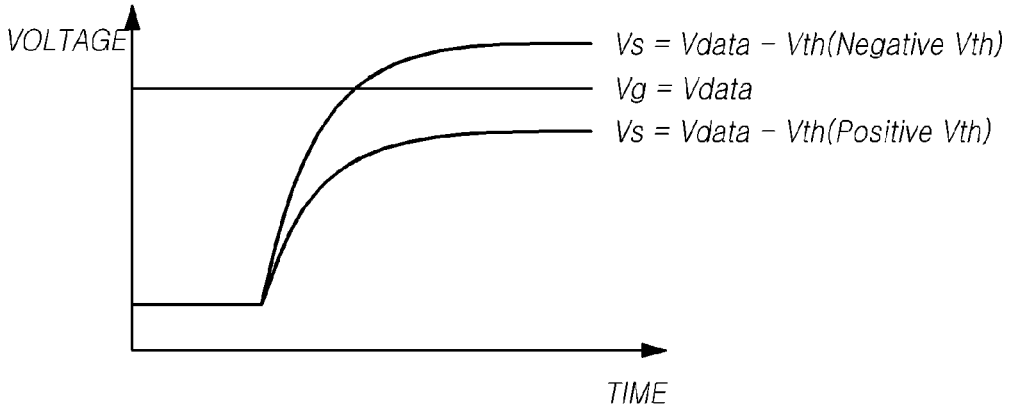

FIG. 3 is a diagram provided to explain a principle of sensing a threshold voltage of the driving transistor DRT of the organic light emitting display device 100 according to the present exemplary embodiments. Herein, the first node N1 of the driving transistor DRT is assumed as a source node. According to a principle of sensing a threshold voltage, a voltage Vs of the source node N1 of the driving transistor DRT is set to follow a voltage Vg of the gate node N2 in a source following operation and after the voltage Vs of the source node N1 of the driving transistor DRT is saturated, the voltage Vs of the source node N1 of the driving transistor DRT is sensed as a sensing voltage Vsense. In this case, it is possible to figure out a change in threshold voltage of the driving transistor DRT on the basis of the sensing voltage Vsense.

In order to sense a threshold of the driving transistor DRT, it is necessary to wait until the driving transistor DRT is turned off. Thus, a sensing speed is low. Therefore, a threshold voltage sensing mode is also referred to as a slow mode S-Mode.

The voltage Vg applied to the gate node N2 of the driving transistor DRT is a data voltage Vdata supplied from the corresponding source driver integrated circuit SDIC. The above-described characteristic compensation for compensating a threshold voltage or mobility of the driving transistor may be performed by any one or more of the data driver and the timing controller. However, the present invention is not limited thereto.

Figure 4:
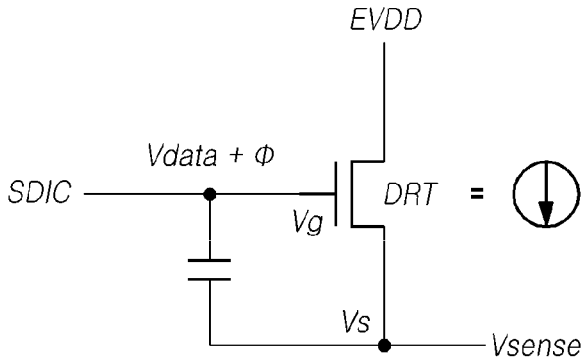
FIG. 4 and FIG. 5 are diagrams provided to explain a principle of sensing a mobility of the driving transistor DRT of an organic light emitting display device 100 according to the present exemplary embodiments.
Figure 4:
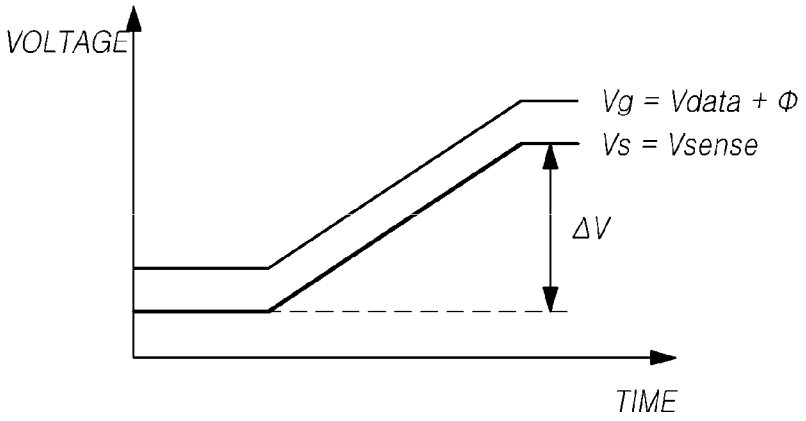
Figure 5:
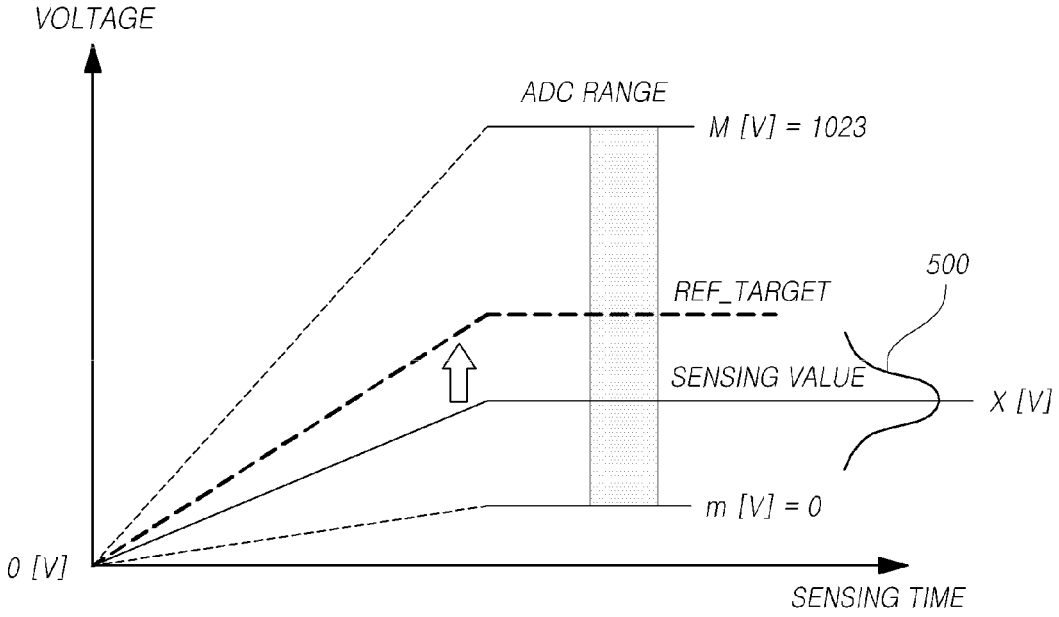

FIG. 4 and FIG. 5 are diagrams provided to explain a principle of sensing a mobility of the driving transistor DRT of an organic light emitting display device 100 according to the present exemplary embodiments.

According to a principle of sensing a mobility of the driving transistor DRT illustrated in FIG. 4, a voltage obtained by adding a predetermined voltage φ to the data voltage Vdata is applied to the gate node N2 of the driving transistor DRT. Herein, the predetermined voltage φ is a voltage corresponding to a threshold voltage compensation value.

It is possible to figure out a relative current performance (i.e. mobility) of the driving transistor on the basis of an amount ΔV of a voltage charged in the line capacitor Cline for a predetermined period of time. Thus, a correction gain for compensation can be obtained.

In order to sense a mobility, the driving transistor DRT is basically turned on. Thus, a sensing speed is high. Therefore, a mobility sensing mode is also referred to as a fast mode F-Mode.

The above-described compensation for a mobility by sensing a mobility may be performed for a predetermined period of time while a screen is driven. Thus, it is possible to sense and compensate a parameter of the driving transistor which is changed in real time.

FIG. 5 is a graph illustrating a change in voltage of the first node N1 of the driving transistor DRT over a sensing time while a mobility sensing is performed. In order to sense a mobility, a sensing value sensed by the sensing unit 310 is converted into a digital value.

The sensing unit 310 has an analog-digital conversion (ADC) range from a digital value 0 corresponding to m [V] to a digital value 1023 corresponding to M [V].

Sensing values for all sub-pixels of the display panel 110 have a certain distribution 500. The distribution 500 corresponds to a distribution of mobility of the driving transistor DRT in all sub-pixels of the display panel 110.

A mobility sensing may be performed when the display panel is initially driven, for example, when the display panel is powered on. According to yet another exemplary embodiment, while the display panel is driven, a mobility sensing may be performed during a vertical blank time V Blank time. The number of lines (gate lines or row lines) to be sensed during the vertical blank time and the number of sub-pixels in each line may be set in various ways. According to an exemplary embodiment, a sub-pixel of one color in one row line may be sensed during a vertical blank time. In a sensing method, a voltage Vdata+Φ for sensing may be supplied to a data line as illustrated in FIG. 2 and the ADC in the sensing unit 310 may read a voltage as illustrated as 220 in FIG. 2. Herein, Φ represents a compensation value for compensating a threshold voltage Vth of each driving transistor.

Before the panel is driven or while the panel is driven, a sensing process is performed to compensate a mobility of a driving transistor in each sub-pixel. In this case, if a sensing time is increased, a waiting time may be increased before use. Particularly, if a compensation of a mobility is performed before the panel is driven, a sensing time for compensating a mobility is needed accordingly. Thus, in this case, there is a problem of a black screen displayed through the display panel. Particularly, in case of a high-resolution or large-size display panel, the number of pixels is increased, and, thus, it takes a lot of time to compensate a mobility. Therefore, in the present specification, a mobility sensing is selectively applied to reduce a time required to compensate a mobility. According to an exemplary embodiment of the present invention, if the display panel is turned on, a sensing for mobility compensation is selectively applied. Thus, it is possible to reduce or remove a sensing time required to compensate a mobility.

In the present specification, selectively performing a sensing may include checking a status or conditions of the display panel and determining whether or not to perform a mobility compensation according to an exemplary embodiment.

In the present specification, selectively performing a sensing may also include checking a status or conditions of the display panel and performing a mobility compensation only to some pixels in the display panel or not performing a mobility compensation to some pixels according to another exemplary embodiment.

Herein, if a mobility compensation is selectively applied to some pixels, the mobility compensation may be performed depending on a color. For example, the mobility compensation may be performed to a pixel of a specific color of R, G, B, and W in all pixels of the display panel according to an exemplary embodiment.

Further, if a mobility compensation is selectively applied to some pixels, the mobility compensation may be performed to some pixels depending on a location in the display panel. For example, if it is determined that a mobility compensation is needed in a specific area on the basis of results of sensing and compensation previously performed, a mobility compensation may be performed only to pixels in the specific area.

Hereinafter, a process of powering on the display panel and determining whether or not to perform sensing by the timing controller according to the present invention will be described.

Figure 6:
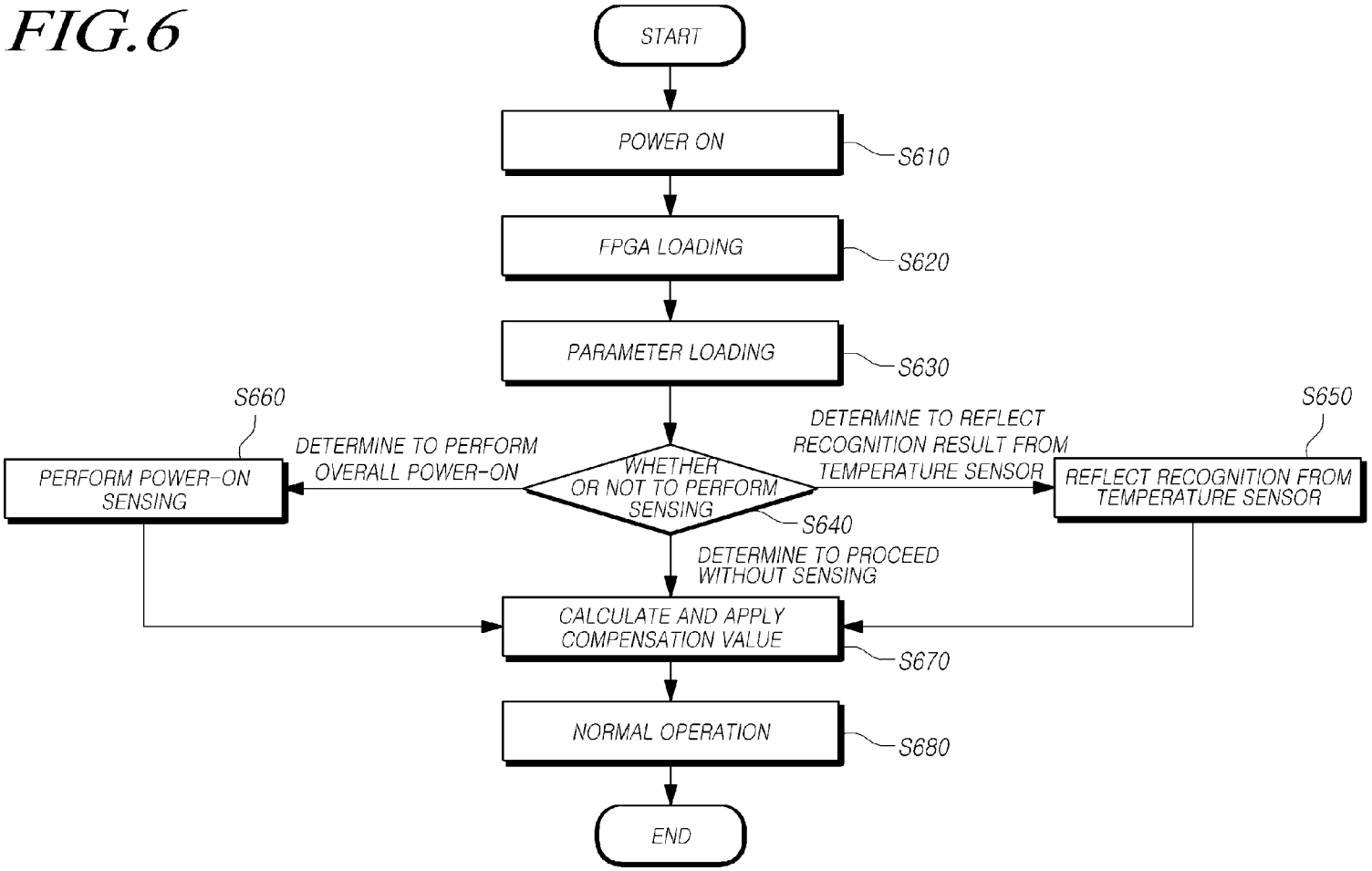
FIG. 6 is a diagram illustrating an operation of a timing controller according to an exemplary embodiment of the present invention.

FIG. 6 is a diagram illustrating an operation of a timing controller according to an exemplary embodiment of the present invention. Upon power-on (S610), the timing controller performs FPGA loading (S620). Then, the timing controller loads parameters necessary to drive the panel (S630). During this process, the timing controller also loads parameters necessary to determine whether or not to perform a power-on sensing. The necessary parameters include whether or not a sensing is needed only to a sub-pixel of a specific color or a sub-pixel in a specific area on the basis of information about a sensing previously performed in the panel, information about a temperature, and a result of a sensing previously performed.

The timing controller determines whether or not to perform a sensing using the above-described parameters (S640). If it is determined that an overall power-on sensing is needed, a power-on sensing is performed (S660). Meanwhile, if it is determined to reflect a recognition result from a temperature sensor, the timing controller reflects recognition of the temperature sensor and performs a sensing (S650). A sensing is performed to an area in need of a sensing or a sub-pixel having a color in need of a sensing. Meanwhile, if it is determined to perform a process without a sensing, the timing controller calculates and applies a past compensation value (S670). Even if a power-on sensing is performed (S660) or a partial sensing reflecting recognition of the temperature sensor is performed (S650), the timing controller calculates and applies a compensation value as a sensing result (s670). Then, a normal operation is performed (S680).

In the step of determining whether or not to perform a sensing (S640), it is possible to determine on the basis of a period of time to turn on the panel after the panel is previously turned off. For example, if a mobility and a threshold voltage are compensated while the panel is turned off and the display panel is turned on after the elapse of a predetermined period of time, characteristics of a sub-pixel are not distorted. Thus, a previous mobility/threshold voltage compensation value can be used. Therefore, in this case, the timing controller does not perform a sensing for mobility compensation. In this case, the timing controller may control a sensing to be performed only when the display panel is turned on within a predetermined period of time.

According to another exemplary embodiment, even if the display panel is powered off and a mobility/threshold voltage is sensed and compensated and then the display panel is powered on within a short period of time, a sensing may not be performed. In case of a re-operation of the display panel within a reliable range of a result of a sensing previously performed, the timing controller may control the display panel to be powered on without a sensing.

Further, according to another exemplary embodiment of the present invention, when the display panel is powered on, the timing controller may sense only some lines and determine whether or not to perform an overall sensing. Further, the timing controller may sense only some of sub-pixels of a specific color and determine whether or not to perform a sensing to the sub-pixels of the specific color. In FIG. 6, if a selective sensing is not applied, only S610, S620, S630, S660, S670, and S680 are performed. Thus, a power-on sensing is performed and an initial driving time is delayed. However, if the exemplary embodiment of the present invention is applied, it is possible to perform a selective driving while the display panel is powered on. Therefore, it is possible to reduce or remove a delay in the initial driving time.

According to an exemplary embodiment of the present invention, a timing controller configured to control a gate driver which applies a signal to a gate line of a display panel in which a plurality of sub-pixels is disposed and a data driver which applies a signal to a data line of the display panel may determine whether or not to perform a sensing during a process for turning on the display panel and selectively perform a sensing. The timing controller may control the gate driver and the data driver by calculating any one or more of a temperature of the display panel, an OFF-ON time difference of the display panel, and a degree of need for sensing of the sub-pixels when the display panel is changed from an OFF state to an ON state, and determining whether or not to perform a sensing to the display panel.

If an exemplary embodiment of the present invention is applied, the timing controller may control the DAC 300 to perform a sensing to sub-pixels in a partial area as illustrated in FIG. 2. If a sensing is performed to sub-pixels of some color, the DAC 300 may apply Vdata for sensing to the sub-pixels of the corresponding color. As a result, it is possible to reduce a time required for sensing.

Figure 7:
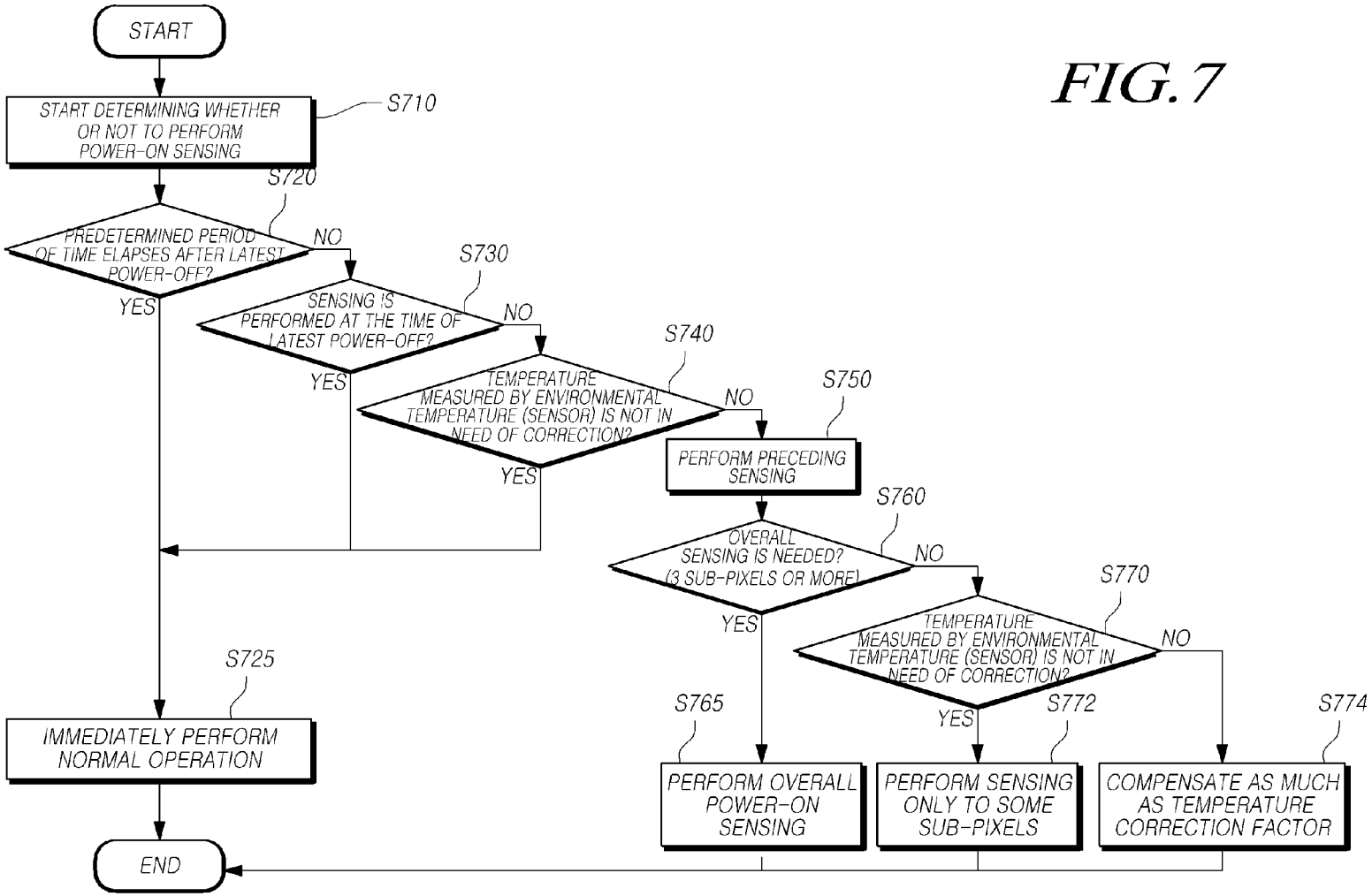
FIG. 7 is a diagram illustrating an algorithm for determining whether or not to perform a power-on sensing according to an exemplary embodiment of the present invention.

FIG. 7 is a diagram illustrating an algorithm for determining whether or not to perform power-on sensing according to an exemplary embodiment of the present invention. A timing controller starts determining whether or not to perform a power-on sensing (S710). A period of time from the latest power-off to turn-on of the panel (S720), whether or not to perform a sensing (S730), a determination of conditions on the basis of environmental information (S740), a determination of an overall sensing through a preceding sensing (S760), and whether or not to correct a temperature (S770) may be checked as factors of determination.

Firstly, the timing controller checks whether or not a predetermined period of time elapses after the latest power-off (S720). This can be checked by recording time information in a memory within the timing controller if the panel is turned off. If the predetermined period of time elapses, it is confirmed that heat generated by circuits within the display panel is sufficiently removed. Thus, a normal operation is immediately performed (S725). Particularly, if a still image is output for a long time and then the panel is turned off, a temperature in a specific area is maintained high.

S720 illustrates an exemplary embodiment where the timing controller controls the gate driver and the data driver to output an image on a display panel without a sensing to a sub-pixel if a difference between a time for completing a sensing to the display panel and a time for changing the display panel to an ON state is higher than a preset reference. As described above, if the timing controller determines that a period of time sufficient to lower a temperature elapses, a process is performed without a sensing. Thus, it is possible to reduce an operation time of the display panel. As a reference for determining a time, a difference between a previous turn-off time of the display panel and a turn-on time may be determined. According to yet another exemplary embodiment, a previous operation time of the display panel may be recorded and an OFF-ON time difference may be proportionally determined on the basis of the recorded operation time. For example, if the display panel is previously maintained in an ON state for 1 hour, the timing controller may consider a resultant temperature increase of the display panel and determine that when an OFF-ON time difference is 10 minutes, a sensing is not needed. If the display panel is maintained in an ON state for 10 hours, the timing controller may consider a resultant temperature increase of the display panel and determine that when an OFF-ON time difference is 30 minutes, a sensing is not needed. That is, in addition to the OFF-ON time difference of the display panel, the timing controller may record a pervious duration of an ON-state of the display panel in the memory and set a reference for an OFF-ON time difference by which a sensing is not needed on the basis of the recorded duration.

Meanwhile, if the predetermined period of time does not elapse, the timing controller checks whether or not a sensing is performed at the time of the latest power-off (S730). If a sensing is performed at the time of power-off, the display panel may be immediately driven without a sensing (S725).

If the process does not proceed to S725 after the determination in S720/S730, the timing controller checks an environmental temperature of the display panel through a sensor and checks whether or not the temperature of the display panel is not in need of a correction according to a sensing result in order to more specifically check whether or not to perform a sensing to the display panel (S740). The temperature sensor may be included in the data driver, more specifically, the source driver of the display panel. According to yet another exemplary embodiment, the temperature sensor may be combined with the gate driver.

If it is determined that the temperature is not in need of a correction, the process proceeds to S725. However, if the measured environmental temperature is in need of a sensing, a preceding sensing is performed (S750). The preceding sensing means a sensing performed to some lines in advance in order to check whether or not to perform a sensing. That is, the timing controller performs a preceding sensing to a specific number of lines and if a variation is equal to or higher than an existing compensation value, the timing controller perform an overall compensation. A preceding sensing may be performed to some of sub-pixels of a specific color and then a variation of the sub-pixels may be checked in order to determine whether or not to perform a sensing to each color. Otherwise, a preceding sensing may be performed to some of sub-pixels in a specific area of the display panel and then it may be determined whether or not the overall specific area is in need of a sensing.

If it is determined that an overall sensing is needed as a result of the preceding sensing, for example, if it is determined that a sensing is needed to sub-pixels of three colors in an RWGB structure (S760), a power-on sensing may be performed to sub-pixels of all colors in order to improve accuracy (S765).

Meanwhile, if it is determined that an overall sensing is not needed, it is checked whether a temperature is not in need of a correction using an environmental temperature (sensor) (S770). In this case, if it is determined that a correction is not needed and only a partial sensing is needed, a sensing may be performed to some of sub-pixels. The sensing to some of sub-pixels means a sensing performed to sub-pixels disposed in a specific area or sub-pixels of a specific color. Further, if the temperature is in need of a correction, the temperature is compensated as much as a temperature correction factor (S774).

The determination in S720, S730, and S740 may be performed by the timing controller. The timing controller checks values stored in the memory when the panel is turned off and on or checks a result of a temperature sensing. The above-described reference is a reference for determining whether or not to turn on the display panel without a sensing or determining whether or not to perform a selective sensing to some of sub-pixels of the display panel. It is possible to reduce a period of time required to display an image when the display panel is in an ON state.

Meanwhile, in S750 through S774, it is determined whether or not the timing controller performs a sensing after the preceding sensing or performs a sensing to an overall/partial area. Details thereof will be described below.

Figure 8:
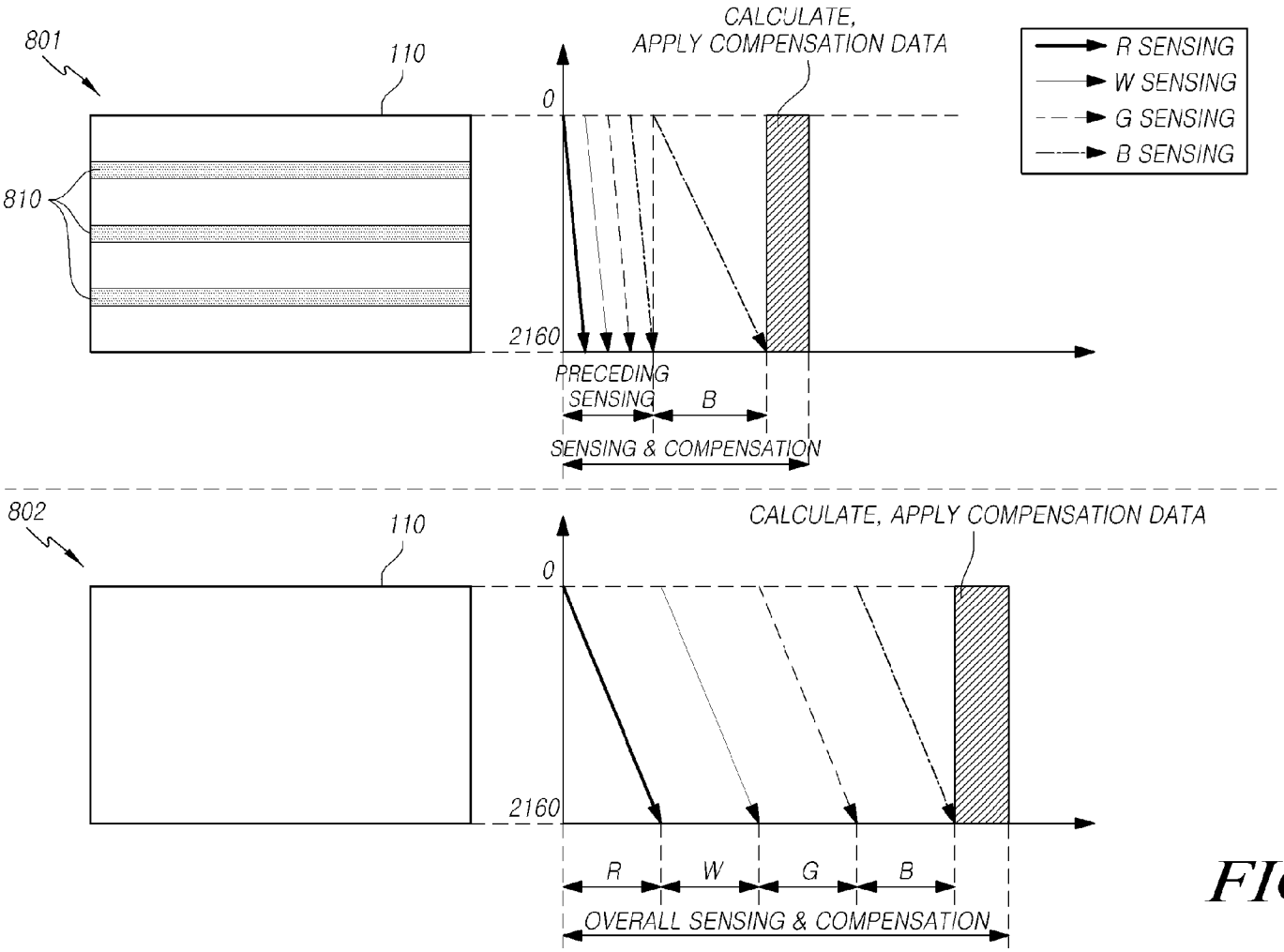
FIG. 8 is a diagram illustrating that a preceding sensing is performed to sense a sub-pixel of a specific color according to an exemplary embodiment of the present invention.

FIG. 8 is a diagram illustrating that a preceding sensing is performed to sense a sub-pixel of a specific color according to an exemplary embodiment of the present invention. 801 in FIG. 8 illustrates a sensing and compensation time in case of performing a preceding sensing by applying the present invention, and 802 in FIG. 8 illustrates a sensing and compensation time in case of performing a power-on sensing without a preceding sensing.

In case of 801, a preceding sensing is performed to some of gate lines 810 of the display panel 110. The timing controller may perform a preceding sensing to sub-pixels of all colors in the corresponding area 810. As a result, if the timing controller determines that a sensing is needed to sub-pixels of a specific color, for example, blue (B), the timing controller performs a sensing to the sub-pixels of the color and calculates and applies compensation data. Since the number of sub-pixels to be sensed is reduced to ¼, a time required for an overall sensing and compensation is reduced. 802 shows a case where a sensing is performed to each of sub-pixels of all colors in the entire panel.

For an accurate sensing, the timing controller may preset a gate line 810 subject to a preceding sensing. In case of presetting the gate line 810, the timing controller may select a gate line having a great change in characteristics as a result of a previous sensing or information about a specific gate line may be set in advance in the memory within the timing controller. Otherwise, the timing controller may randomly determine the gate line 810 subject to a preceding sensing. If the number of gate liens subject to a preceding sensing is increased, the accuracy is increased but the total sensing time is also increased. An optimum environment for both the accuracy and the total sensing time may be selected.

Figure 9:
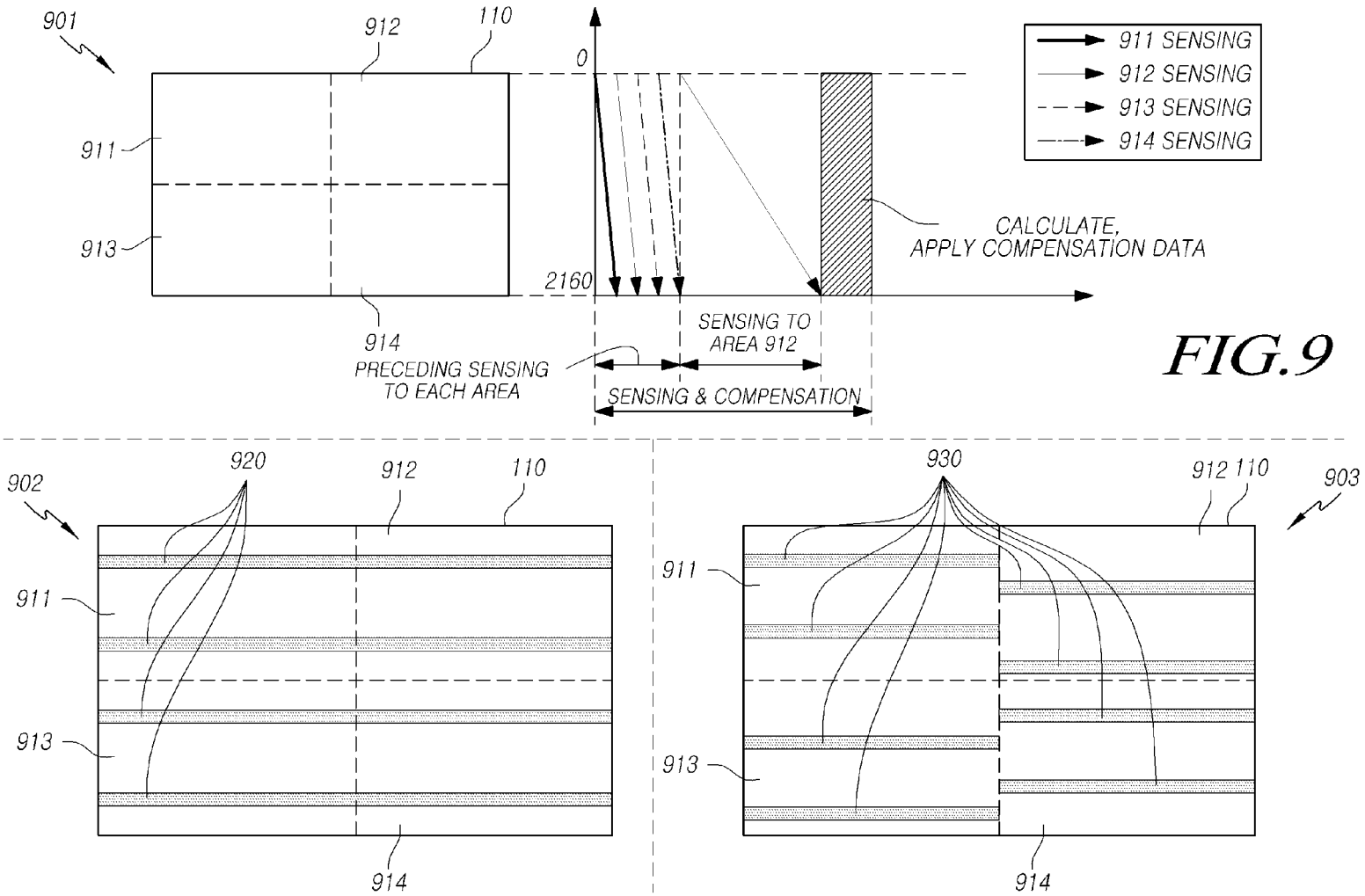
FIG. 9 is a diagram illustrating that a preceding sensing is performed to sense a sub-pixel in a specific area according to another exemplary embodiment of the present invention.

FIG. 9 is a diagram illustrating that a preceding sensing is performed to sense a sub-pixel in a specific area according to another exemplary embodiment of the present invention. As indicated by 901, the display panel 110 is divided into four areas 911, 912, 913, and 914. A preceding sensing is performed to some of sub-pixels in each of the four areas. The preceding sensing may be performed to some of sub-pixels as indicated by 902 or 903.

As indicated by 902, the timing controller may perform a preceding sensing to sub-pixels connected to common gate lines 920 in each of the areas 911, 912, 913, and 914 and then perform a sensing to all sub-pixels in a specific area (for example, 912).

As indicated by 903, the timing controller may perform a preceding sensing to sub-pixels connected to independent gate lines 930 in each of the areas 911, 912, 913, and 914 and then perform a sensing to all sub-pixels in a specific area (for example, 912).

According to FIG. 8 and FIG. 9, a sensing is selectively performed only to sub-pixels satisfying a specific condition, and, thus, a time required for a sensing is reduced at the time of power-on. Therefore, it is possible to suppress a delay in the initial driving time. Particularly, in case of a large-size display panel, a sensing and a compensation are performed only to sub-pixels in need of a sensing. Thus, an image quality can be improved and an initial time required to drive panel can be reduced.

Meanwhile, in FIG. 9, it may be determined to perform a sensing to a specific area by checking an environmental temperature sensor rather performing a preceding sensing. For example, if temperatures of the areas 911, 912, 913, and 914 are checked and the temperatures of the respective areas are not in need of a correction, a sensing may be performed to sub-pixels of a partial area or some sub-pixels in the entire panel. Meanwhile, if the timing controller checks the environmental temperature sensor and a temperature is in need of a correction, the timing controller may perform a compensation to all sub-pixels as much as a temperature correction factor without performing a sensing.

Figure 10:
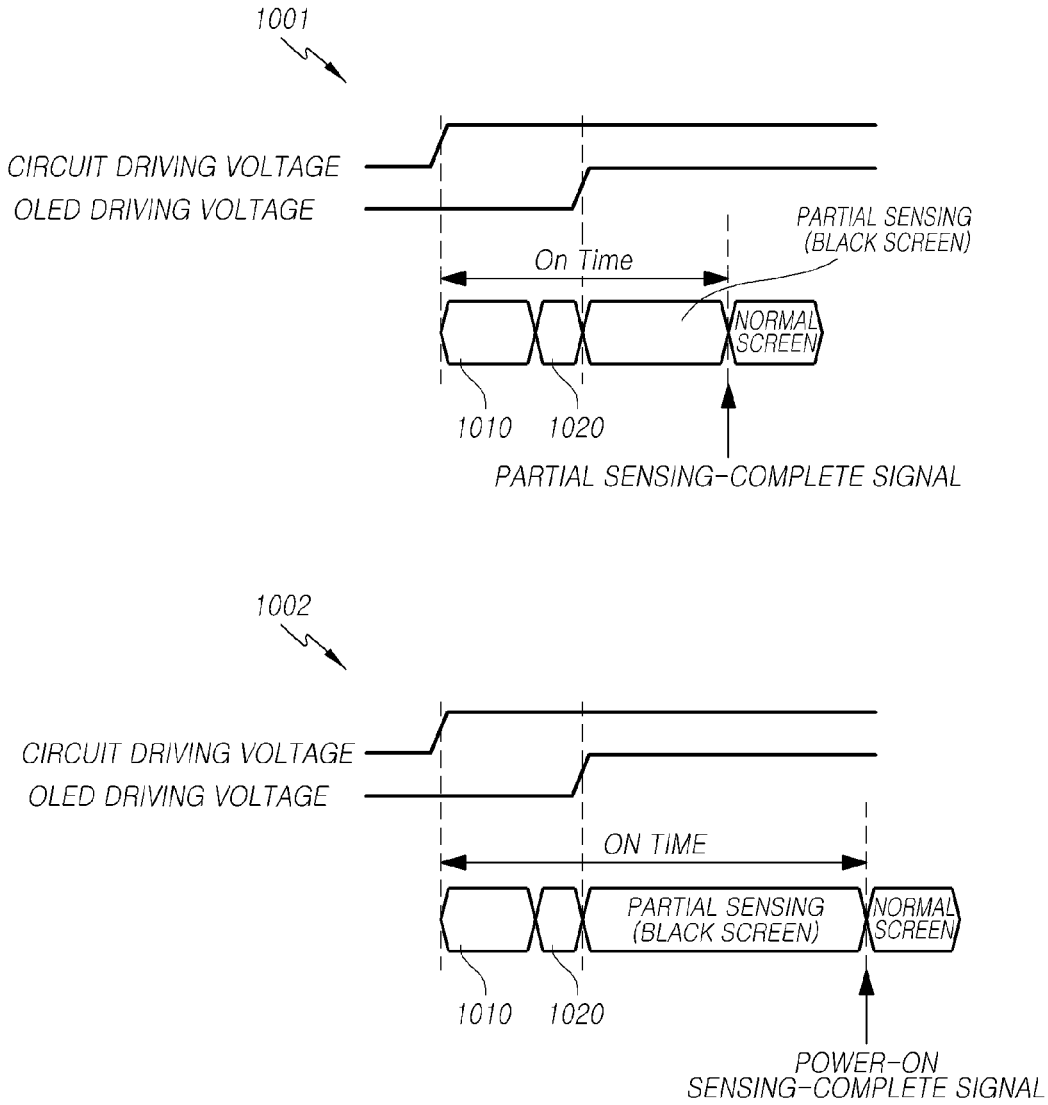
FIG. 10 is a diagram illustrating a time reduced until a screen is checked in a normal driving operation after a display panel is turned on according to an exemplary embodiment of the present invention.

FIG. 10 is a diagram illustrating a time reduced until a screen is checked in a normal driving operation after a display panel is turned on according to an exemplary embodiment of the present invention. 1001 and 1002 illustrate that it takes time 1010 and 1020 to reach a state where the timing controller, the gate driver, and the data driver can be operated after applying a circuit driving voltage. Meanwhile, if each of the timing controller, the gate driver, and the data driver can be operated by the circuit driving voltage, an OLED driving voltage is applied. If the OLED driving voltage is applied, in case of performing a selective sensing according to an exemplary embodiment of the present invention, a partial sensing is performed as indicated by 1001. In this case, a black screen is displayed. Further, when the sensing is completed, a normal screen is displayed. Meanwhile, if an overall sensing is performed as indicated by 1002, a black screen is displayed while a sensing is performed to sub-pixels in the entire panel. Therefore, in case of 1002 as compared with the case 1001, a black screen is displayed for a longer time. When the sensing is completed, a sensing-complete signal is applied and a normal screen is displayed. By reducing a sensing time, the display device can rapidly operate after receiving an ON signal. Further, by omitting a sensing process to sub-pixels which are not in need of a sensing, an unnecessary operation of the display panel can be omitted. To this end, the gate driver and the data driver are controlled by the timing controller and a selective sensing can be performed by applying a signal to a specific gate line or a specific data line.

Figure 11:
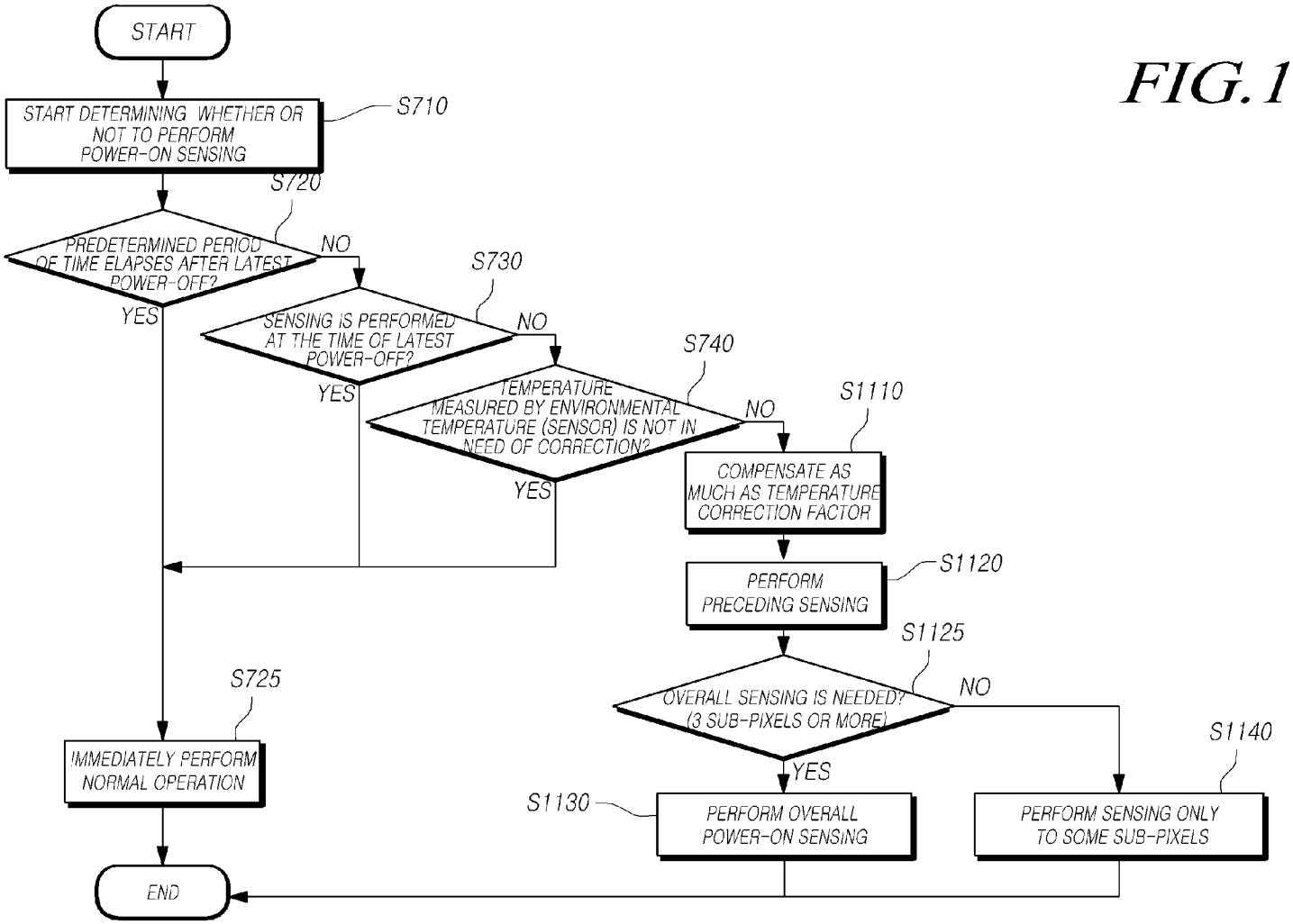
FIG. 11 is a diagram illustrating a process of checking various environmental factors and a status of a sub-pixel and determining whether or not perform a sensing by a timing controller when a display panel is changed to an ON state according to yet another exemplary embodiment of the present invention.

FIG. 11 is a diagram illustrating a process of checking various environmental factors and a status of a sub-pixel and determining whether or not perform a sensing by a timing controller when a display panel is changed to an ON state according to yet another exemplary embodiment of the present invention.

S710 through S740 in FIG. 11 refer to FIG. 7. In S740, it is checked whether a temperature measured by the environmental temperature (sensor) is in need of a correction. If it is not in need of a correction, the process proceeds to S725. If it is in need of a correction, the temperature is compensated as much as a temperature correction factor (S1110). According to an exemplary embodiment, a sensing and a correction are immediately ended in this step and an image is displayed through the display panel.

Meanwhile, according to another exemplary embodiment, if it is determined that the temperature is in need of a correction, the temperature is compensated as much as a temperature correction factor (S1110) and a preceding sensing is performed to some sub-pixels (S1120). By performing the preceding sensing, it is determined whether or not an overall sensing is needed (S1125). If it is determined that an overall sensing is needed by checking each color or specific area, an overall power-on sensing is performed (S1130). If not, a sensing is performed only to some sub-pixels (S1140). According to an exemplary embodiment, a sensing is performed to sub-pixels of a specific color or in a specific area as described above.

As described with reference to FIG. 7, the preceding sensing means a sensing performed to some lines in advance in order to check whether or not to perform a sensing. That is, the timing controller performs a preceding sensing to a specific number of lines and if a variation is equal to or higher than an existing compensation value, the timing controller perform an overall compensation. A preceding sensing may be performed to some of sub-pixels of a specific color and then a variation of the sub-pixels may be checked in order to determine whether or not to perform a sensing to each color. Otherwise, a preceding sensing may be performed to some of sub-pixels in a specific area of the display panel and then it may be determined whether or not the overall specific area is in need of a sensing.

If it is determined that an overall sensing is needed as a result of the preceding sensing, for example, if it is determined that a sensing is needed to sub-pixels of three colors in an RWGB structure (S760), a power-on sensing may be performed to sub-pixels of all colors in order to improve accuracy (S765).

Meanwhile, if it is determined that an overall sensing is not needed, i.e., if it is determined that only a partial sensing is needed, a sensing may be performed to some of sub-pixels. The sensing to some of sub-pixels means a sensing performed to sub-pixels disposed in a specific area or sub-pixels of a specific color.

In case of applying the present invention to a high-resolution display such as UHD, when each pixel is compensated by an external compensation method, a mobility sensing may be selectively applied.

According to an exemplary embodiment of the present invention, when the display panel is powered on, a power-on sensing is performed only when a condition for determining whether or not to perform a sensing is satisfied.

If the condition is not satisfied, a power-on sensing is not performed but the panel is normally driven with an existing compensation value. Thus, it is possible to display and provide a normal screen to a user as soon as possible. Therefore, it is possible to provide a display device with increased visibility and improved user convenience.

According to the above-described condition for determination, the timing controller selectively perform a sensing depending on a time elapsed after the latest power-off of the panel. Otherwise, according to another condition for determination, the timing controller determines whether or not to update a compensation value calculated by a sensing at the time of the last power-off and then selectively performs a sensing. Further, the timing controller may selectively perform a sensing using an environmental temperature measured with a temperature sensor. Further, the timing controller may perform a preceding sensing to a partial area, compare data and then selectively perform a sensing to sub-pixels of a specific color or sub-pixels disposed in a specific area.

Since a power-on sensing is performed under the above-described exemplary condition, it is possible to reduce awaiting time until a normal screen is displayed after power-on. Further, since a sensing is performed when a sensing is needed to the display panel under the above-described exemplary condition, it is possible to reduce an unnecessary panel sensing time as much as possible without deterioration in display quality of the panel.

If it is determined whether or not to perform an overall sensing by sensing sub-pixels connected to specific gate lines under the above-described exemplary condition, the timing controller may compare a result of the sensing to specific sub-pixels with an existing reference value for compensation and then determine whether or not to perform a sensing to the entire panel. Further, the timing controller may perform a preceding sensing and then determine whether or not to perform a sensing only to sub-pixels of a specific color or in a specific area.

Since a sensing is performed only under the above-described exemplary condition, it is possible to control the timing controller to perform a sensing only when a sensing is needed while maintaining the accuracy required for a panel compensation. Therefore, it is possible to improve a quality of the display device and reduce a driving waiting time.

Figure 12:
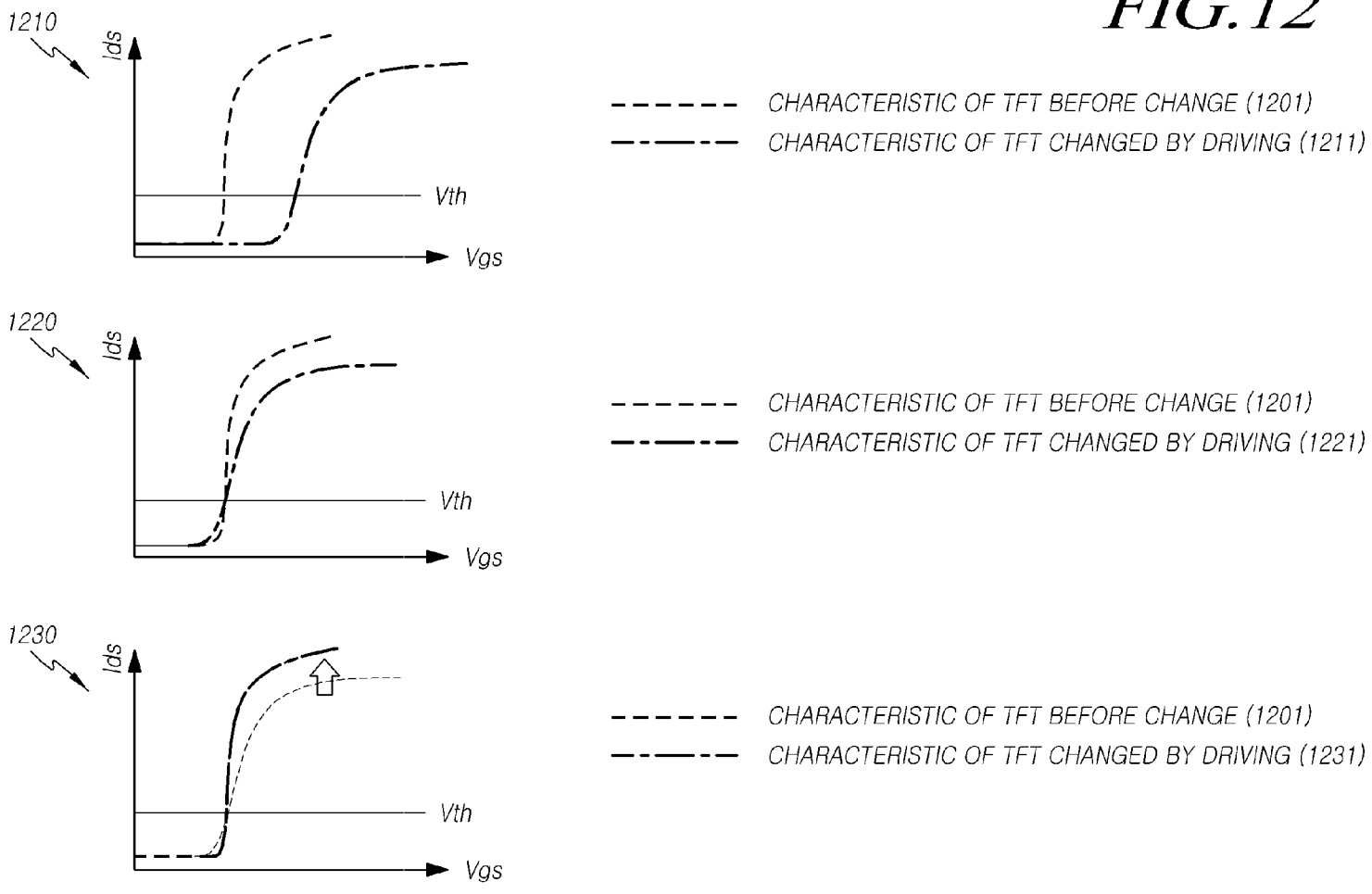
FIG. 12 is a diagram illustrating a change in characteristics of a TFT when a sensing compensation is performed according to an exemplary embodiment of the present invention.

FIG. 12 is a diagram illustrating a change in characteristics of a TFT when a sensing compensation is performed according to an exemplary embodiment of the present invention.

A characteristic 1201 of a TFT before a mobility and a threshold voltage are changed prior to a driving is compared with characteristics 1211, 1221, and 1231 of the TFT with a mobility and a threshold voltage changed by the driving.

1210 shows a state where a threshold voltage compensation and a mobility compensation are not performed. It can be seen that the characteristic 1211 of the TFT changed by the driving is different from 1201 in a threshold voltage Vth and a mobility.

1220 shows a state where a threshold voltage compensation is completed. It can be seen that the characteristic 1221 of the TFT changed by the driving is identical with 1201 in a threshold voltage Vth and but different from 1201 in a mobility.

1230 shows a state where a threshold voltage compensation and a mobility compensation are completed. It can be seen that the characteristic 1231 of the TFT changed by the driving is identical with the characteristic 1201 of the TFT.

If the timing controller compensates a threshold voltage and a mobility while the panel is turned off, the panel can be turned on without performing a sensing as long as TFT characteristics in a sub-pixel correspond to 1230 according to the above-described conditions (a temperature, a duration of power-on after power-off of the panel, a result of a preceding sensing, and the like).

If a temperature or a result of a preceding sensing to TFTs of some sub-pixels corresponds to the characteristic 1220, the timing controller may perform a sensing to all sub-pixels or some sub-pixels to perform a compensation.

Figure 13:
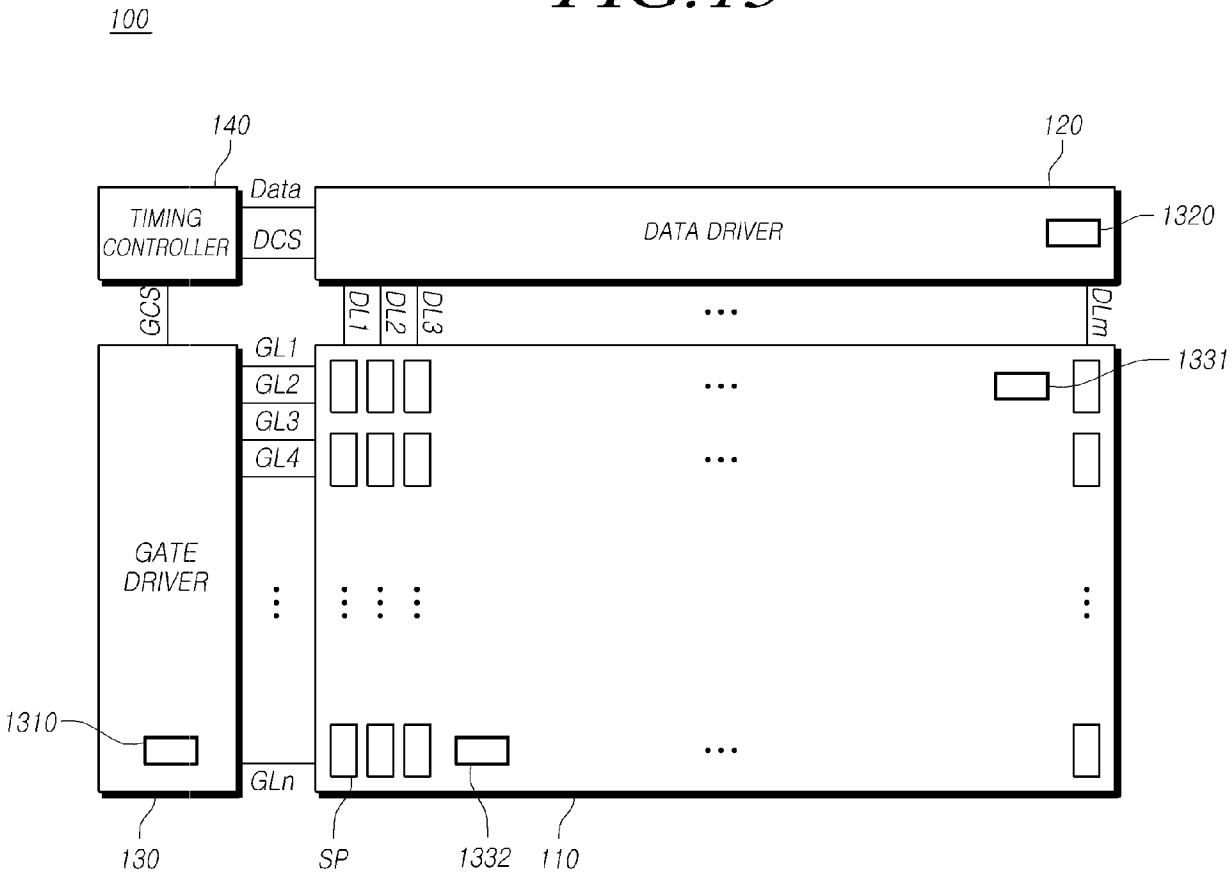
FIG. 13 is a diagram illustrating an area where a temperature sensor can be disposed according to an exemplary embodiment of the present invention.

FIG. 13 is a diagram illustrating an area where a temperature sensor can be disposed according to an exemplary embodiment of the present invention. A temperature sensor 1310 may be included in the gate driver 130, and a temperature sensor 1320 may be included in the data driver 120. Further, temperature sensors 1331 and 1332 may be included in a specific area within the display panel 110. A location of a temperature sensor in the gate driver 130, the data driver 120, or the display panel 110 within the display device may vary depending on a configuration for temperature sensing. The temperature sensor may be disposed in an area suitable for more accurately sensing a temperature. If a plurality of temperature sensors is disposed, when a sensing is performed to each area, a temperature can be sensed from subdivided areas. Further, areas suitable for a selective sensing are diversified, and, thus, it is possible to reduce a sensing time when the panel is turned on.

If the present invention is applied, a mobility sensing operation can be selectively performed in order to compensate a mobility by an external compensation. Through a driving TFT of a pixel, a sensing recognition line (Vref line) is sensed as a voltage over time like any one of FIG. 12. In this case, a sensing is performed to a sub-pixel in need of a sensing or sub-pixels (1220 and 1210 in FIG. 12) expected to be in need of a sensing and a compensation is applied as shown by 1230 to operate the sub-pixel. A sensing may be performed to some sub-pixels by applying the present invention. An ADC provided in the data driver may read a specific sensing voltage and a ICON may recognize the amount of voltage to be compensated by comparing the specific sensing voltage with existing compensation data. Then, a value for correcting the amount of compensation as much as a difference with respect to a reference voltage is calculated and input to each pixel.

If the present exemplary embodiments are applied, a mobility of a driving TFT in each pixel of a high-resolution OLED display can be sensed. As the resolution of a display is increased, a size of a pixel is decreased, and a size of a driving TFT of an OLED is further decreased in order to secure an opening ratio. Further, if an OLED display includes an oxide TFT which is greatly changed in temperature and temporal characteristic, it is necessary to compensate the TFT characteristics of each pixel in real time. However, it may take a lot of time to compensate TFT characteristics of a pixel in real time. Therefore, when the display panel is changed to an ON state, the timing controller may check whether or not a characteristic compensation is needed and selectively perform a sensing.

In order to perform a real-time compensation according to the present invention, preferably, characteristics of the entire panel may be sensed and a normal operation (image signal input, screen display) when the panel is turned on. However, if the real-time compensation is performed all the time, it may take a longer time to perform the normal operation of the panel in addition to a signal processing of a digital TV.

According to the present invention, in order to reduce such a time, it is determined whether or not a sensing is needed on the basis of a temperature of a display panel, an OFF-ON time difference of the display panel, and a result of sensing characteristics of sub-pixels in each area or of each color and then a sensing is performed to some of the sub-pixels or the display panel is turned on without performing a sensing. Thus, it is possible to reduce a time required to turn on the panel.

It will be apparent to those skilled in the art that various modifications and variations can be made in the present invention without departing from the spirit or scope of the invention. Thus, it is intended that the present invention cover the modifications and variations of this invention provided they come within the scope of the appended claims and their equivalents.

What is claimed is:

1. An organic light emitting display device comprising:

a display panel in which a plurality of sub-pixels is disposed;

a gate driver configured to apply a signal to a gate line in the display panel;

a data driver configured to apply a signal to a data line in the display panel; and a timing controller configured to control the gate driver and the data driver by calculating any one or more of a temperature of the display panel, an OFF-ON time difference of the display panel, and a degree of need for sensing of the sub-pixels and determining whether or not to perform a sensing to the display panel when the display panel is changed from an OFF state to an ON state, wherein each of the sub-pixels includes an organic light emitting diode and a driving transistor configured to drive the organic light emitting diode, and the timing controller controls the gate driver and the data driver in order to control a selective sensing to driving transistors of the sub-pixels when the display panel is changed from the OFF state to the ON state.

2. The organic light emitting display device according to claim 1, wherein the timing controller controls the gate driver and the data driver to output an image on the display panel without a sensing to the sub-pixels if a difference between a time for completing a sensing to the display panel and a time for changing the display panel to the ON state is higher than a preset reference.

3. The organic light emitting display device according to claim 1, further comprising: a temperature sensor configured to check a temperature, wherein the timing controller controls a selective sensing to the sub-pixels depending on the temperature sensed by the temperature sensor.

4. The organic light emitting display device according to claim 1, wherein the timing controller performs a preceding sensing to some sub-pixels in the display panel to control a sensing to the plurality of sub-pixels represented by the some sub-pixels.

5. The organic light emitting display device according to claim 4, wherein the preceding sensing is performed to sub-pixels selected by color from the sub-pixels constituting the display panel, and the timing controller controls a sensing to all sub-pixels of a color represented by the sub-pixels according to a result of the preceding sensing.

6. The organic light emitting display device according to claim 4, wherein the preceding sensing is performed to sub-pixels selected from sub-pixels constituting divided areas in the display panel, and the timing controller controls a sensing to all sub-pixels in an area represented by the sub-pixels according to a result of the preceding sensing.

7. A timing controller that controls a gate driver configured to apply a signal to a gate line in a display panel in which a plurality of sub-pixels is disposed and a data driver configured to apply a signal to a data line in the display panel, and controls the gate driver and the data driver by calculating any one or more of a temperature of the display panel, an OFF-ON time difference of the display panel, and a degree of need for sensing of the sub-pixels and determining whether or not to perform a sensing to the display panel when the display panel is changed from an OFF state to an ON state, wherein each of the sub-pixels includes an organic light emitting diode and a driving transistor configured to drive the organic light emitting diode, and the timing controller controls the gate driver and the data driver in order to control a selective sensing to driving transistors of the sub-pixels when the display panel is changed from the OFF state to the ON state.

8. The timing controller according to claim 7, wherein the timing controller controls the gate driver and the data driver to output an image on the display panel without a sensing to the sub-pixels if a difference between a time for completing a sensing to the display panel and a time for changing the display panel to the ON state is higher than a preset reference.

9. The timing controller according to claim 7, wherein the timing controller controls a selective sensing to the sub-pixels depending on a temperature sensed by a temperature sensor included in any one of the display panel, the gate driver, or the data driver.

10. The timing controller according to claim 7, wherein the timing controller performs a preceding sensing to some sub-pixels in the display panel to control a sensing to the plurality of sub-pixels represented by the some sub-pixels.

11. The timing controller according to claim 10, wherein the preceding sensing is performed to sub-pixels selected by color from the sub-pixels constituting the display panel, and the timing controller controls a sensing to all sub-pixels of a color represented by the sub-pixels according to a result of the preceding sensing.

12. The timing controller according to claim 10, wherein the preceding sensing is performed to sub-pixels selected from sub-pixels constituting divided areas in the display panel, and the timing controller controls a sensing to all sub-pixels in an area represented by the sub-pixels according to a result of the preceding sensing.

* * * * *